US010259140B1

(12) United States Patent
Derose et al.

(10) Patent No.: US 10,259,140 B1
(45) Date of Patent: Apr. 16, 2019

(54) PORTABLE CONCRETE MIXER FOR HYDRATING AND MIXING CONCRETE MIX CONTAINING GRAVEL AGGREGATE IN A CONTINUOUS PROCESS

(71) Applicant: SIMPLECRETE LLC, Amarillo, TX (US)

(72) Inventors: Dirk Derose, Tulsa, OK (US); Oscar T. Scott, IV, Amarillo, TX (US)

(73) Assignee: Red Dog Mobile Shelters, LLC, Amarillo, TX (US)

( * ) Notice: Subject to any disclaimer, the term of this patent is extended or adjusted under 35 U.S.C. 154(b) by 0 days.

(21) Appl. No.: 16/165,893

(22) Filed: Oct. 19, 2018

(51) Int. Cl.
*B28C 5/12* (2006.01)
*B28C 5/08* (2006.01)
(Continued)

(52) U.S. Cl.
CPC ..... *B28C 5/1246* (2013.01); *B01F 7/00391* (2013.01); *B01F 7/00408* (2013.01); *B01F 7/00441* (2013.01); *B28C 5/0831* (2013.01); *B28C 5/1215* (2013.01); *B28C 5/1253* (2013.01); *B28C 7/064* (2013.01); *B28C 7/126* (2013.01)

(58) Field of Classification Search
CPC ..... B28C 5/1246; B28C 5/1253; B28C 7/064; B28C 5/0831; B28C 7/126; B28C 5/1215; B01F 7/00391; B01F 7/00441; B01F 7/00408
See application file for complete search history.

(56) References Cited

U.S. PATENT DOCUMENTS 722,113 A * 3/1903 Koelner ..... B01F 7/00391 198/662
789,614 A * 5/1905 Koelner ..... A21C 1/02 366/98
(Continued)

FOREIGN PATENT DOCUMENTS

DE 1684048 A1 * 4/1971
DE 4119261 A * 12/1992
EP 584573 B1 * 3/1998

OTHER PUBLICATIONS

Spec Mix, LLC (2018), Material Delivery System: D2W Workhorse Continuous Mixing System, pp. 1-2, www.specmix.com, Copyright 2018.

*Primary Examiner* — Tony G Soohoo
(74) *Attorney, Agent, or Firm* — Russell Ng PLLC; Brian F. Russell

(57) ABSTRACT

A portable concrete mixer includes a frame, a hopper, coupled to the frame, for receiving therein dry commercially available prepackaged concrete mixes containing gravel aggregates, a chute coupled to the hopper, a water supply system that supplies water to the chute, a motor, and an auger coupled to and rotated by the motor. The auger includes a shaftless helical auger body extending from the hopper into the chute via an aperture in the hopper. The shaftless helical auger body has an interior volume and a plurality of fingers extending from the auger body into the interior volume. The shaftless helical auger body has an uneven pitch such that a second portion of the helical auger body in the chute has a greater pitch than a first portion of the helical auger body in the hopper.

19 Claims, 7 Drawing Sheets

(51) Int. Cl.

| | |
|---|---|
| ***B01F 7/00*** | (2006.01) |
| ***B28C 7/06*** | (2006.01) |
| ***B28C 7/12*** | (2006.01) |

(56) References Cited

U.S. PATENT DOCUMENTS 2,366,673 A * 1/1945 Paley ..... A61F 13/04 106/783
2,509,543 A * 5/1950 Truax ..... B65G 33/00 198/669
2,538,891 A * 1/1951 Zimmerman ..... B01F 7/00708 118/303
2,571,300 A * 10/1951 Simpson ..... B01F 7/00391 241/101.8
2,608,395 A * 8/1952 August ..... B01F 7/00708 198/548
2,709,075 A * 5/1955 August ..... B01F 7/00391 198/662
2,806,680 A * 9/1957 August ..... B01F 7/00391 198/300
2,953,360 A * 9/1960 Kline ..... A01D 90/105 198/580
3,085,789 A * 4/1963 Heider ..... B01F 13/0035 366/133
3,185,451 A * 5/1965 Snyder ..... B01F 7/00408 366/66
3,186,602 A * 6/1965 Ricciardi ..... B65B 1/12 198/540
3,206,174 A * 9/1965 Young ..... B01F 7/086 106/277
3,248,092 A * 4/1966 Atkins ..... B01F 7/0045 366/301
3,310,293 A * 3/1967 Zimmerman ..... B28C 9/0463 366/6
3,339,898 A * 9/1967 Futty ..... B28C 5/0862 366/6
3,377,000 A * 4/1968 Mason, Jr. ..... B28C 7/0477 222/227
3,387,829 A * 6/1968 Nangoh ..... B01F 3/18 366/37
3,439,836 A * 4/1969 Ricciardi ..... A47J 47/01 222/240
3,459,409 A * 8/1969 Goldberger ..... B28C 5/1246 366/40
3,482,821 A * 12/1969 Blackwood ..... B01F 13/0035 366/186
3,494,511 A * 2/1970 Daignas ..... B28C 5/1215 222/236
3,535,280 A * 10/1970 Gerlach ..... B01J 19/20 159/13.1
3,570,569 A * 3/1971 Hartley ..... A21C 1/06 241/82.6
3,606,277 A * 9/1971 Kader ..... B28C 5/1253 366/50
3,710,983 A * 1/1973 Ricciardi ..... B01F 7/00408 222/141
3,897,723 A * 8/1975 Lucy, Jr. ..... A22C 5/00 366/102
4,071,226 A 1/1978 Miller
4,117,547 A 9/1978 Mathis et al.
4,123,226 A * 10/1978 Vanderveen ..... B01F 7/0065 23/314
4,146,690 A * 3/1979 Tago ..... B01F 7/00175 525/367
4,187,030 A * 2/1980 Godley ..... B01F 7/0065 198/666
4,383,093 A * 5/1983 Shiraki ..... B01F 7/00408 422/135
4,441,231 A * 4/1984 Baccetti ..... A22C 9/004 366/320
4,444,509 A * 4/1984 Steiner ..... B01F 9/08 366/143
4,551,024 A * 11/1985 Clapp ..... B28C 9/0463 366/347
4,618,294 A 10/1986 Brown
4,733,607 A * 3/1988 Star ..... B01F 7/00208 366/149
4,827,455 A * 5/1989 Sivachenko ..... B01F 7/00408 366/292
4,855,960 A 8/1989 Janssen et al.
4,907,890 A 3/1990 Lepper
4,953,752 A 9/1990 Tousignant et al.
4,956,821 A 9/1990 Fenelon
4,997,284 A 3/1991 Tousignant et al.
5,213,414 A * 5/1993 Richard ..... B01F 7/08 366/156.2
5,333,762 A * 8/1994 Andrews ..... B65G 65/46 198/671
5,342,124 A * 8/1994 Swisher, Jr. ..... B01F 7/00158 366/173.2
5,354,127 A * 10/1994 Del Zotto ..... B01F 7/087 366/186
5,358,331 A * 10/1994 Cruse ..... B01F 7/00391 366/158.1
5,415,323 A 5/1995 Fenelon
5,524,796 A * 6/1996 Hyer ..... B65G 33/18 198/662
5,609,416 A 3/1997 Duckworth
5,718,508 A * 2/1998 Williams ..... B01F 7/00433 366/138
5,785,420 A 7/1998 Schuff
6,030,112 A * 2/2000 Milek ..... B01F 7/00391 366/320
6,099,159 A * 8/2000 Yoshida ..... B01F 7/00391 366/156.1
6,183,560 B1 * 2/2001 Sarrasin ..... A01C 1/06 118/19
6,517,232 B1 * 2/2003 Blue ..... B01F 3/1228 366/297
7,070,316 B1 * 7/2006 Roth ..... B28C 5/0893 366/242
7,645,064 B2 * 1/2010 Cestti ..... B01F 7/022 366/40
8,408,382 B2 * 4/2013 Pano ..... A47J 31/404 198/550.01
8,763,599 B2 7/2014 Karau et al.
9,132,952 B1 * 9/2015 Knepp ..... B28C 5/40
9,521,828 B2 * 12/2016 Brooks ..... A01K 5/0225
2002/0093876 A1 * 7/2002 Dillinger ..... B28C 9/004 366/13
2003/0152450 A1 8/2003 Henry et al.
2005/0236257 A1 * 10/2005 Schaer ..... B01F 7/00391 198/493
2005/0276152 A1 * 12/2005 Goode ..... B28C 5/34 366/6
2006/0280026 A1 * 12/2006 Dackefjord ..... B01F 7/00058 366/8
2008/0101153 A1 * 5/2008 Swisher ..... B01F 7/00133 366/47
2010/0021277 A1 1/2010 Fritz et al.
2016/0207014 A1 * 7/2016 Onan ..... B01F 15/0267

* cited by examiner

PORTABLE CONCRETE MIXER FOR HYDRATING AND MIXING CONCRETE MIX CONTAINING GRAVEL AGGREGATE IN A CONTINUOUS PROCESS

BACKGROUND OF THE INVENTION

The present invention relates in general to a concrete mixer and, in particular, to a portable concrete mixer that hydrates and mixes a prepackaged concrete mix containing gravel aggregate in a continuous process.

Concrete is a building material commonly used in a variety of construction applications. In many cases, the volume of concrete required for a particular application and/or the number of personnel available to handle the uncured concrete does not warrant delivery of the concrete via a mixer or ready-mix truck. Instead, for small jobs, concrete is often prepared in batches by emptying one or more sacks of prepackaged concrete mix into a wheelbarrow, adding water in various amounts, and then mixing the resulting slurry by hand utilizing tools such as a hoe or shovel until the desired consistency is reached. For slightly bigger jobs, concrete can be mixed from bags of concrete mix or from raw materials (e.g., aggregates, cement, and water) in a rotating drum mixer, which can be powered, for example, by electricity or a gasoline or diesel motor.

BRIEF SUMMARY

The present disclosure recognizes that conventional techniques for mixing concrete have significant drawbacks. For example, the concrete slurry is frequently too wet or too dry, which can lead to a need to repetitively add more water and/or dry mix to the slurry to achieve a desired consistency. Depending upon the skill and/or experience of the individual doing the mixing, the consistency of different batches of concrete often differs significantly. Further, the work involved in cleaning the tools and the drum mixer utilized in preparation of the concrete is laborious. In fact, it is common for a drum mixer to be discarded after mixing several hundred sacks of concrete mix due to the difficulty and labor required to remove the dried and hardened concrete from the crevices and small spaces in and around the internal paddles inside the drum.

The present disclosure also recognizes that continuous process mortar mixers are currently available for mixing bags of prepackaged mortar mix for brick and stone laying, joint pointing, and other applications. Although the contents of these prepackaged mortar mixes vary depending upon the intended application and required mortar properties, prepackaged mortar mixes do not include aggregate ingredients larger in grain size than "sand," which is defined herein according to the Wentworth scale as a granular material having a grain size of between 0.062 mm and 2.0 mm. In general, prepackaged mortar mixes commonly include silica sand having a relatively homogenous grain size of about 0.5 mm. Because continuous process mortar mixers are specifically designed to exclusively mix commercial prepackaged mortar mixes, these continuous process motor mixers cannot accept or mix commercially available prepackaged concrete mixes due to their inability to accommodate the gravel aggregates present in concrete mixes, where "gravel" is defined according to the Wentworth scale as a granular material having a grain size ranging from 2.0 mm to 64.0 mm.

According to one or more embodiments, an improved portable concrete mixer is provided, which hydrates and mixes sacks of prepackaged concrete mix containing gravel aggregate in a continuous process.

In one or more embodiments, a portable concrete mixer includes a frame and a hopper, coupled to the frame, for receiving therein dry concrete mix containing gravel aggregate, a chute coupled to the hopper, a water supply system that supplies water to the portable concrete mixer, a motor, and an auger coupled to and rotated by the motor. The auger includes a shaftless helical auger body extending from the hopper into the chute via an aperture in the hopper. The shaftless helical auger body has an interior volume and a plurality of fingers extending from the auger body into the interior volume. A second portion of the helical auger body in the chute has a greater pitch than a first portion of the helical auger body in the hopper.

In various embodiments, the pitch of the second portion of the helical auger body can increase continuously or in a step-wise fashion.

In at least some embodiments, the portable concrete mixer is configured to facilitate ease of cleanup, thus reducing or eliminating the cleaning issues common to drum mixers.

DETAILED DESCRIPTION

Figure 1:
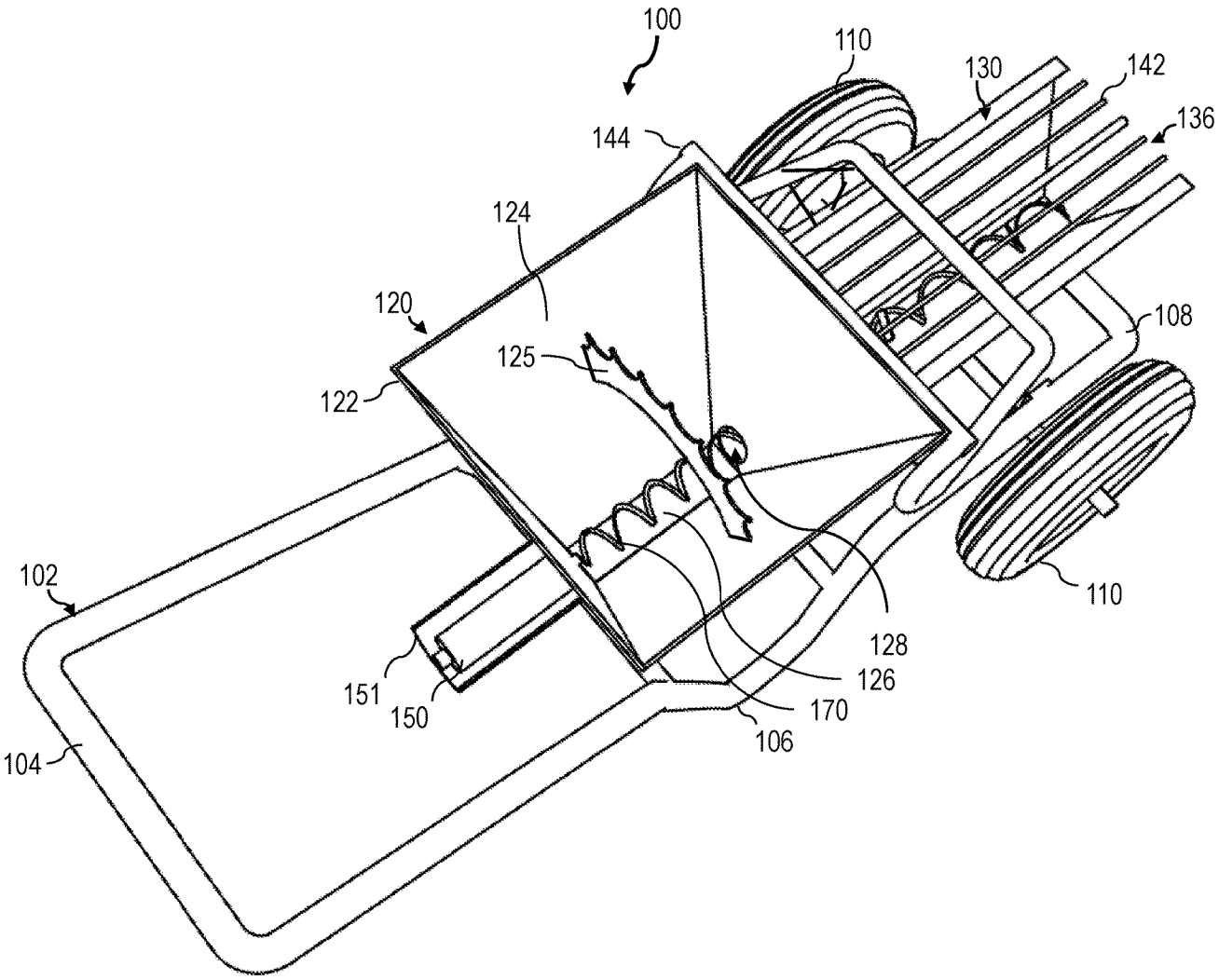
FIG. 1 is illustrated a perspective view of a portable concrete mixer in accordance with one embodiment.
Figure 2:
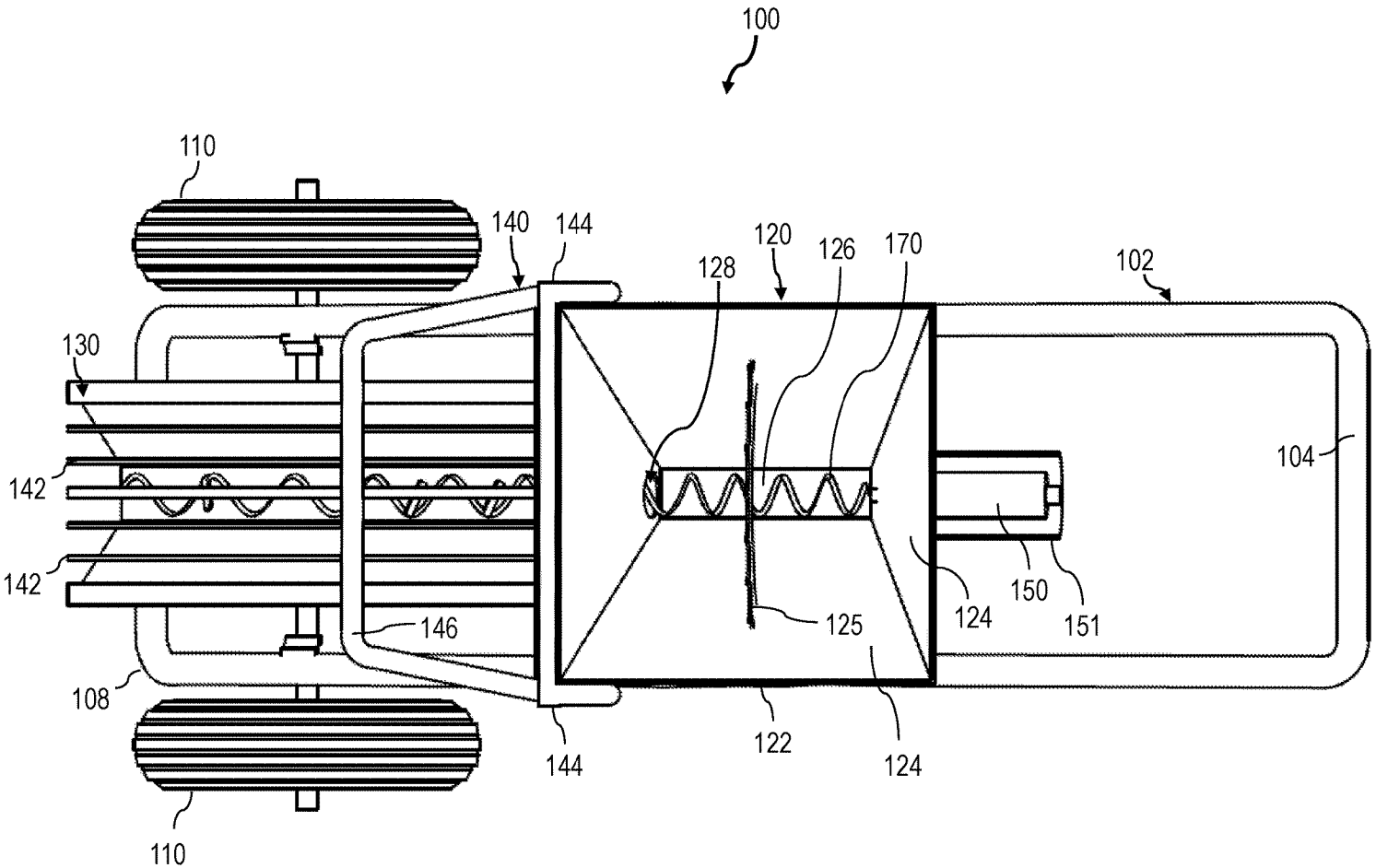
FIG. 2 depicts a top view of a portable concrete mixer in accordance with one embodiment.
Figure 3:
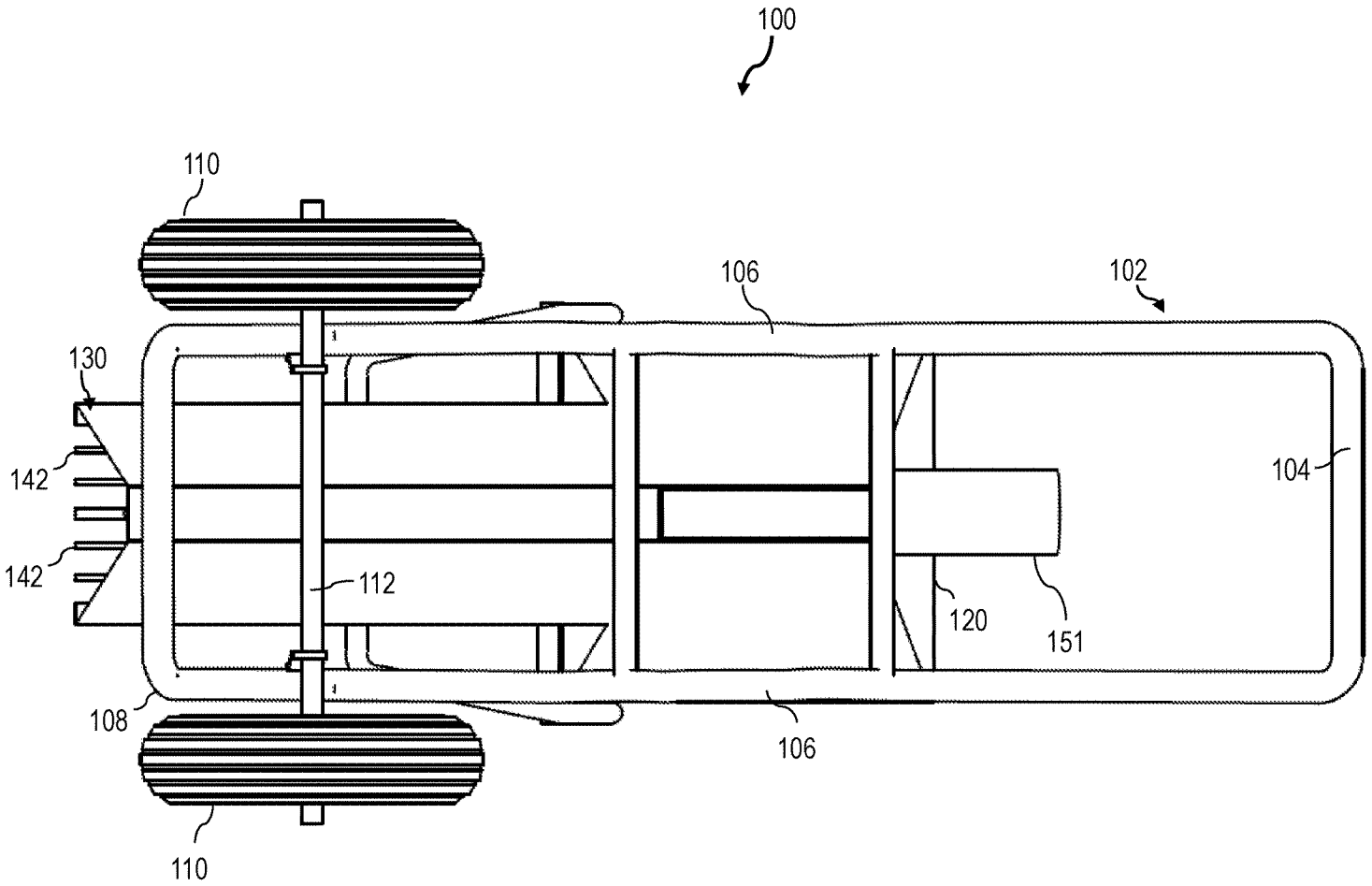
FIG. 3 illustrates a bottom view of a portable concrete mixer in accordance with one embodiment.
Figure 4:
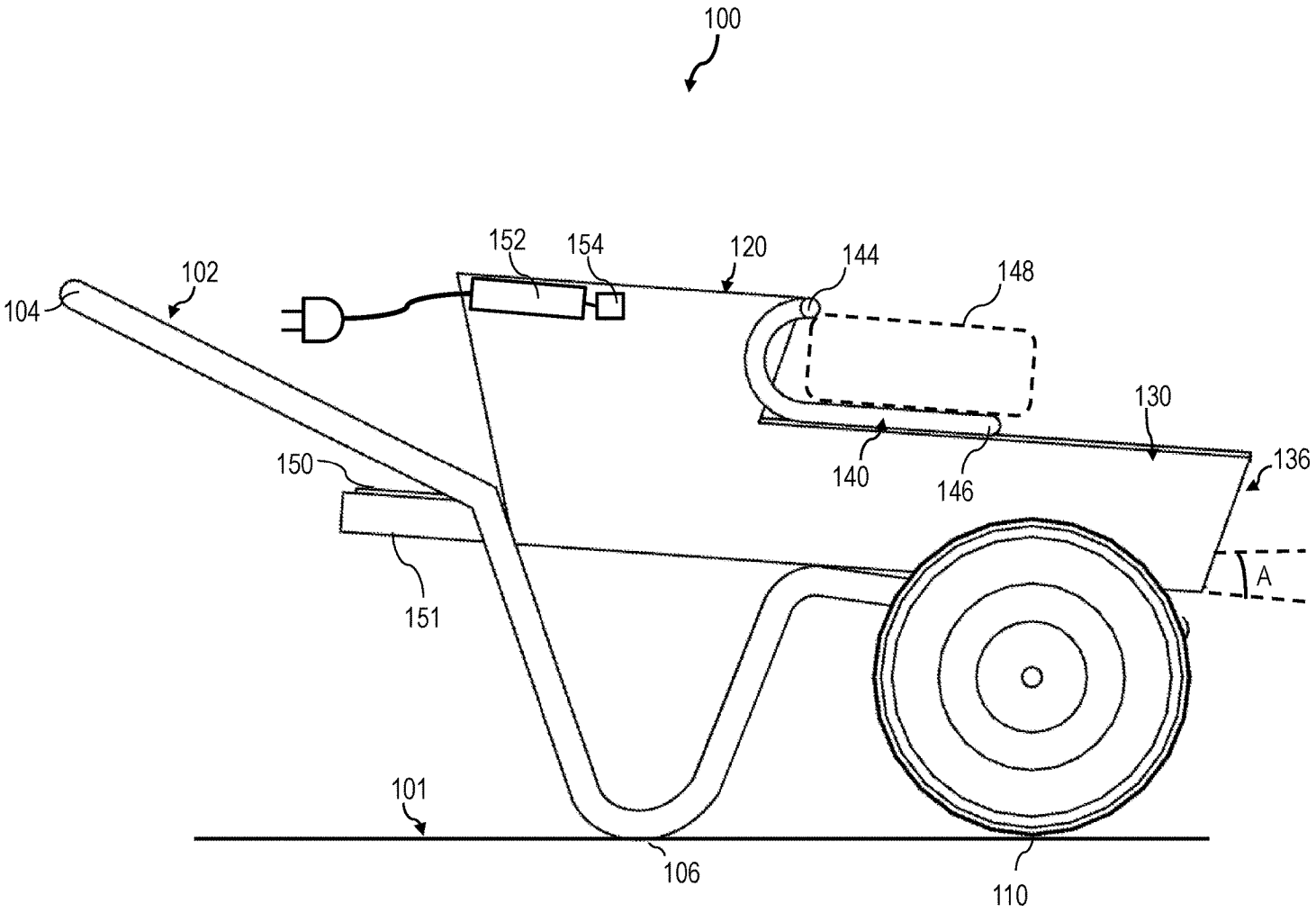
FIG. 4 illustrates a right side elevation view of a portable concrete mixer in accordance with one embodiment.
Figure 5:
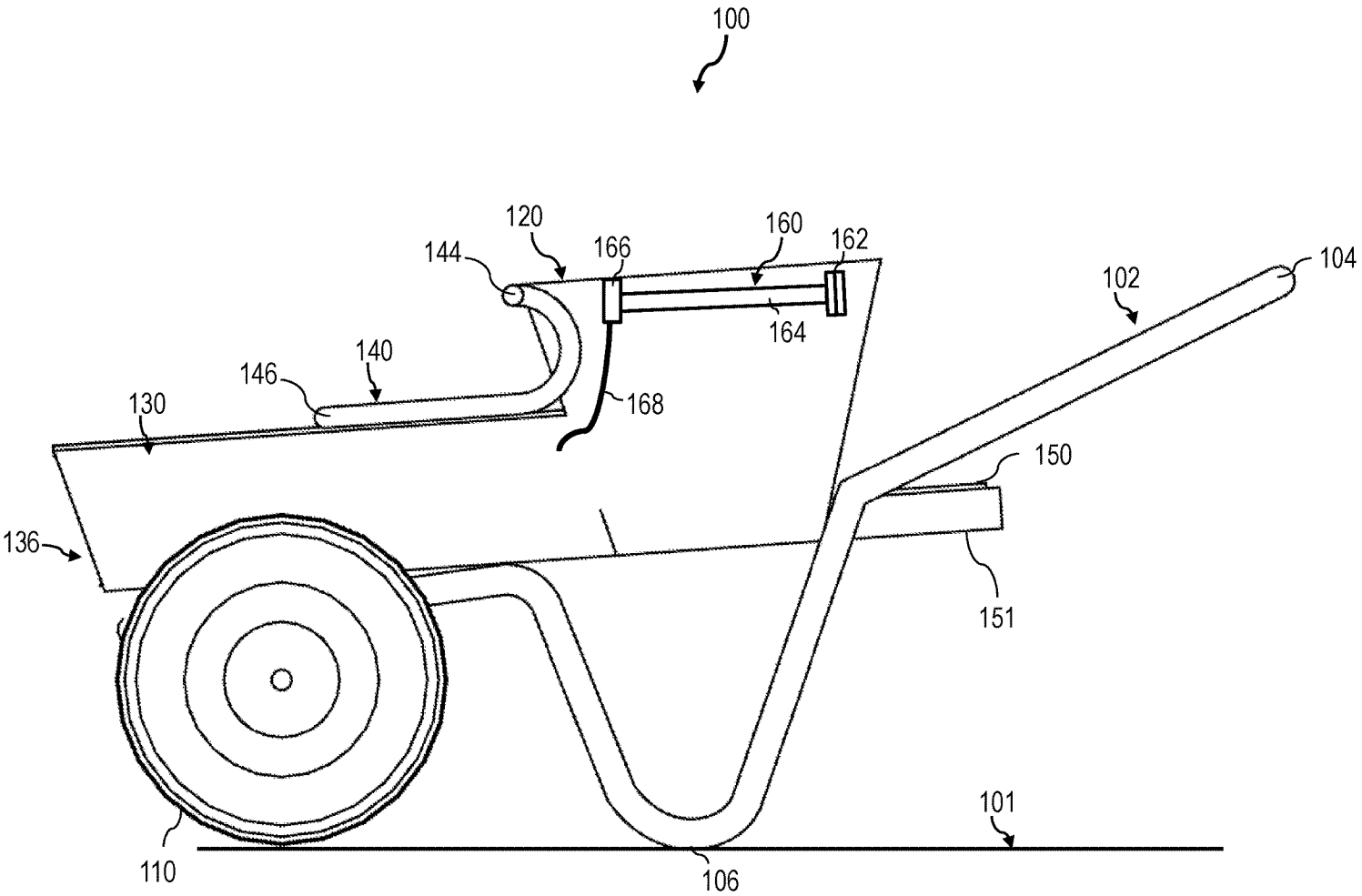
FIG. 5 depicts a left side elevation view of a portable concrete mixer in accordance with one embodiment.
Figure 7:
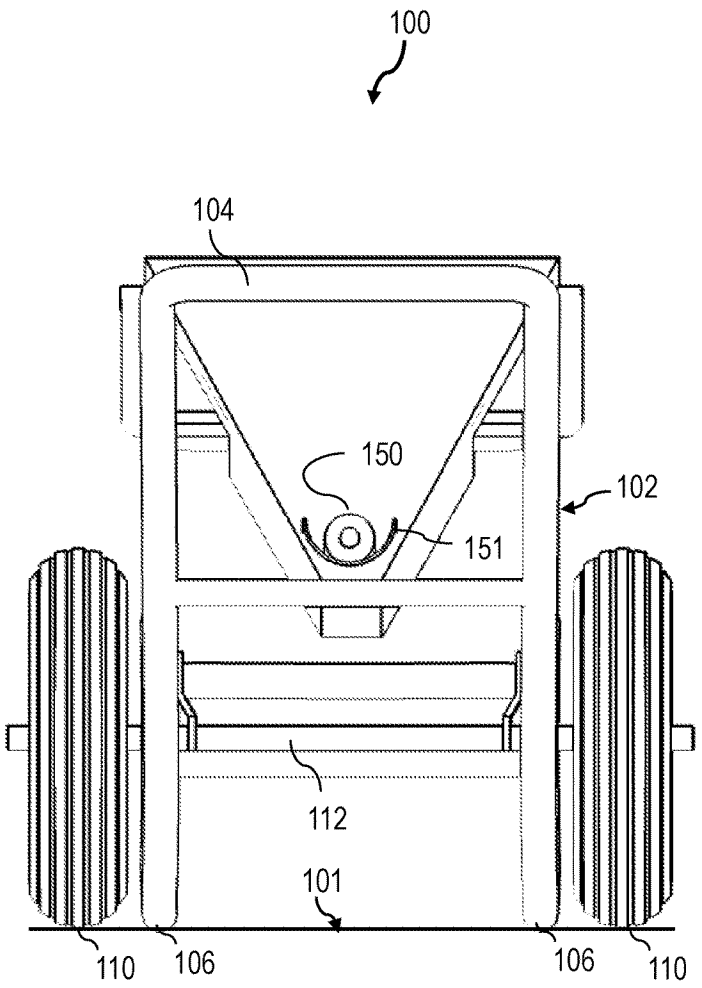
FIG. 7 depicts a back elevation view of a portable concrete mixer in accordance with one embodiment.
Figure 6:
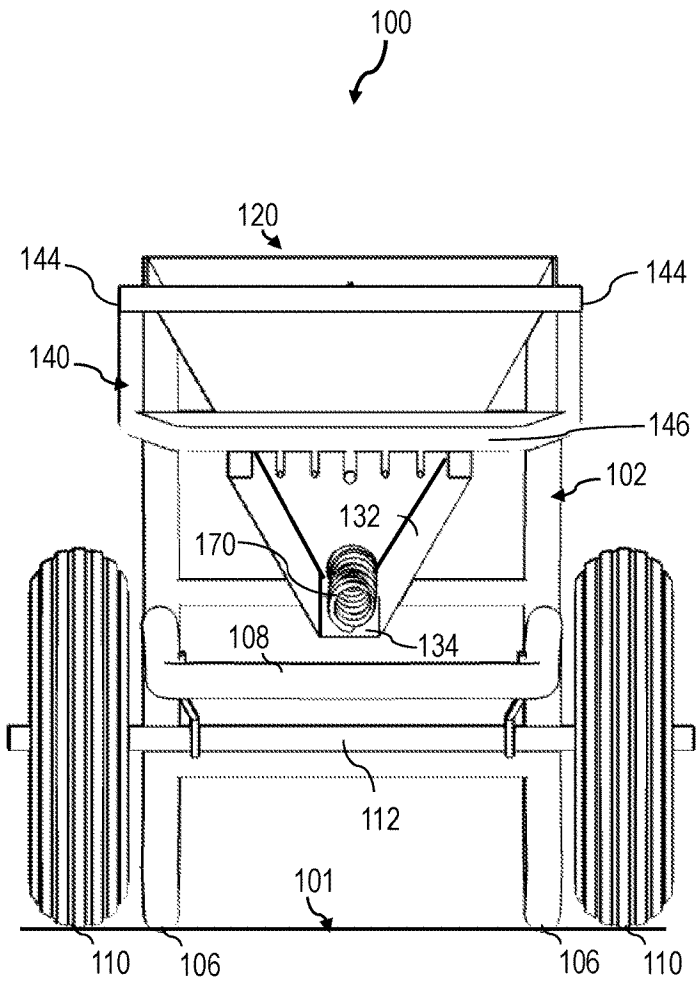
FIG. 6 illustrates a front elevation view of a portable concrete mixer in accordance with one embodiment.

With reference now to the figures, there is illustrated a portable concrete mixer 100 in accordance with one embodiment. In particular, FIG. 1 provides a perspective view of portable concrete mixer 100; FIGS. 2-3 provide top and bottom views, respectively, of portable concrete mixer 100; FIGS. 4-5 provide right side and left side elevation views, respectively, of portable concrete mixer 100; and FIGS. 6-7 provide front and back elevation views, respectively, of portable concrete mixer 100. As described further herein, portable concrete mixer 100 can be used to hydrate and mix sacks of prepackaged concrete mix containing gravel aggregate in a continuous process. For example, portable concrete mixer 100 can be utilized to mix standard 40-pound, 50-pound, 60-pound, or 80-pound sacks of prepackaged concrete mix. In typical continuous operation, portable concrete mixer 100 can produce approximately 1 cubic yard of concrete per hour. In different embodiments, greater or lesser output can be obtained by simply replacing the auger described herein in any given portable mixer unit with an auger of greater or lesser diameter.

In the depicted embodiment, portable concrete mixer 100 has a frame 102, which can be formed out of a durable material, such as fiberglass, plastic, wood, and/or tubular steel. Frame 102 has a handle portion 104 by which portable concrete mixer 100 can be manually pushed or pulled to position portable concrete mixer 100 at a desired position on a job site. In a preferred embodiment best seen in FIGS. 1-3 and 7, handle portion 104 is continuous between the right side pictured in FIG. 4 and the left side pictured in FIG. 5 to allow a user to move portable concrete mixer 100 with a single hand. Frame 102 additionally includes one or more (and in this example, two) rests 106, which in this example are integral with handle portion 104. Rests 106 support a back portion of frame 102 on an underlying substrate 101 (see FIGS. 4-5). Frame 102 additionally includes a front portion 108 to which one or more (and preferably, two) wheels 110 are coupled by at least one axle 112. With this arrangement, a user can lift handle portion 104 to raise rests 106 above the underlying substrate, roll portable concrete mixer 100 to a desired position on a job site on wheels 110, and then park portable concrete mixer 100 in a stable condition at the desired position. In various embodiments, each wheel 110 can include a central rim on which a pneumatic or foam-filled tire is mounted, or alternatively, can be formed of a solid disk (e.g., of plastic or fiberglass).

Portable concrete mixer 100 further includes a hopper 120 for receiving therein dry prepackaged concrete mix (e.g., Sakrete™ or Quikrete™), which typically includes predetermined proportions of cement, aggregate (e.g., gravel and possibly sand), accelerants, retardants, binders and other proprietary chemicals to enhance final product performance. Prepackaged concrete mixes commonly include locally sourced natural or crushed rock or recycled concrete aggregate having a grain size greater than 0.19 inches (about 3 mm), and more commonly, between 0.375 and 1.5 inches. This gravel aggregate commonly forms between 60% and 75% of the total volume of the prepackaged concrete mix. Hopper 120 is preferably formed out of a durable material, such as fiberglass, plastic, or sheet metal (e.g., steel). As shown, hopper 120 has a rim 122, one or more inwardly sloping sidewalls 124 with a slope appropriate to ensure smooth delivery/discharge recognizing the repose angle of the prepackaged concrete mix being utilized, and a base 126 to which concrete mix placed in hopper 120 is uniformly funneled/dispensed under gravitational force. Near base 126, a sidewall 124 has an aperture 128 formed therein through which an auger 170 extends and through which prepackaged concrete mix is transported by the rotation of the auger 170, as discussed further below.

As shown, hopper 120 can conveniently include a bag opener 125, which in the illustrated embodiment comprises an arched serrated blade. In a preferred embodiment, the sidewall(s) 124 of hopper 120 are spaced such that the leading surface of an unopened sack of prepackaged concrete mix dropped into hopper 120 will be deformed convexly and placed under tension through the contact of the sack with the sidewall(s) 124 of hopper 120. Bag opener 125 is preferably located substantially centrally front-to-back within hopper 120 and at a height relative to the inward slope of sidewall(s) 124 such that bag opener 125 will perforate the tensioned, leading convex surface of the sack, allowing the concrete mix contained therein to spill into hopper 120 under the urging of gravity. Once perforated, the sack is preferably left in hopper 120 until a majority of the sack's contents have spilled out in order to reduce the amount of air-borne silica dust. After the sack is mostly emptied, the sack can be lifted by its ends to completely empty its contents into hopper 120 and can then be removed from the top of hopper 120.

Hopper 120 can have a variety of sizes in different embodiments. For example, in some embodiments, hopper 120 is between about 12 and 24 inches across in each dimension at rim 122, and more particularly, between about 15 and 20 inches, and still more particularly, about 17 inches across in each dimension. Further, in some embodiments, hopper 120 is between about 7 and 16 inches deep, and more particularly, between about 8 and 12 inches deep. In these embodiments, hopper 120 is sized to hold approximately 100 pounds of dry concrete mix.

In at least some preferred embodiments, it is desirable for portable concrete mixer 100 to be easy for one or two person work crews to lift, transport, deploy, and use. For example, in some embodiments, it is desirable for portable concrete mixer 100 to be less than about 80 pounds, and still more preferably, less than about 60 pounds, and even more preferably, to be approximately 50 pounds. In addition, frame 102, wheels 110, and hopper 120 are sized and configured such that the height of top of hopper 120 is less than about four feet above the underlying substrate 101, and more preferably, less than about three feet above the underlying substrate 101, and still more particularly, in the range of about 24 inches to 30 inches above the underlying substrate 101. This height limitation makes the task of lifting sacks of concrete mix and loading their contents into the top of hopper 120 much easier and safer than loading a conventional barrel mixer.

Aperture 128 of hopper 120 communicates with a chute 130, which in the depicted embodiment has two inwardly sloping sidewalls 132 and a base 134 and extends between hopper 120 and an open end 136. In one exemplary embodiment, chute 130 is between about 16 and 30 inches in length, and more particularly, between about 16 and 24 inches, and still more particularly, between about 16 and 20 inches in length. These ranges of lengths allow portable concrete mixer 100 to remain compact, while providing sufficient opportunity for the concrete mix to be thoroughly mixed with water as it traverses chute 130. When portable concrete mixer 100 is resting on a level substrate 101, chute 130 preferably has a declination from aperture 128 of hopper 120 to open end 136 shown at angle A in FIG. 4. In various embodiments, angle A is preferably in the range of about −5 degrees (where chute 130 has a slight inclination) to 30 degrees declination, and more particularly, about 0 to 30 degrees, and still more particularly, in the range of 1 to 10 degrees, and yet more particularly, about 5 degrees. In preferred embodiments in which chute 130 has a small downward slope, the concrete slurry formed in chute 130 slowly flows toward open end 136 under the urging of gravity. In the illustrated embodiment, open end 136 is mitered at an angle to the normal, which permits portable concrete mixer 100 to be conveniently stowed in a smaller floor space when not in use by placing portable concrete mixer 100 in an upright position with open end 136 and wheels 110 contacting underlying substrate 101.

The top of chute 130 is optionally but preferably covered during rotation of auger 170 by a guard 140, which includes one or more elements 142 that together substantially bridge the open area between the tops of sidewalls 132. Guard 140 aids in prevention of injury due to the inadvertent contact of a user's body or clothing with a rotating auger 170. In at least some preferred embodiments, guard 140 is pivotally coupled to hopper 120 by hinges 144 so that a user can rotate guard 140 up and away from the top of chute 130 for ease of cleaning. In the illustrated example, guard 140 includes a reinforcing bar 146, which can be coupled (e.g., welded or bolted) to elements 142. As shown in FIG. 4, reinforcing bar 146 preferably provides sufficient structural support to guard 140 to allow one or more sacks 148 of prepackaged concrete mix to be transported or stowed resting on reinforcing bar 146. In other embodiments, guard 140 can cover auger 170 in both chute 130 and hopper 120. For example, in one example, guard 140 may include a series of straight rods resting on the top surface of chute 130, penetrating through holes in the forward sidewall 124 that includes aperture 128, and extending to the back sidewall 124 of hopper 120, thus providing protection from contact with auger 170 along its entire length. In at least some embodiments, chute 130 may optionally further include a hold down strap (not illustrated) spanning sidewalls 132 that limits the axial displacement of auger 170 (e.g., as it is displaced from axial alignment by contact with gravel aggregate in the concrete mix).

Portable concrete mixer 100 additionally includes a motor 150 for rotating auger 170. In the depicted example, motor 150 is an electric motor, which is removably coupled (e.g., by bolts) to the lower back surface of hopper 120 and partially shielded by a motor cowling 151. The illustrated mounting arrangement protects electric motor 150 from physical impact and contact with water and provides an air space around electric motor 150 to ensure adequate cooling. In this arrangement, a small through hole in hopper 120 (not specifically illustrated) allows a motor shaft of motor 150 to be coupled to and axially rotate auger 170. For example, in one embodiment, the motor shaft of electric motor 150 is coupled to auger 170 by a left hand Acme thread. In some embodiments like that shown in FIG. 4, electric motor 150 can be powered by standard 110-230 V AC mains power, which, if electric motor 150 is a DC motor, can be transformed by a power transformer 152 into DC power of suitable voltage. In other embodiments, electric motor 150 can alternatively or additionally be powered by a battery, such as a standard 12 V DC automobile battery. In testing of a portable concrete mixer 100 utilizing a 1/6 HP DC motor, a standard 12 V DC automobile battery has been shown to be capable of powering the mixing of up to fifty 80-pound sacks of concrete mix. In at least some embodiments, the power system of portable concrete mixer 100 includes a manual multi-position switch 154 that allows to auger 170 to be operated in forward and reverse directions or stopped. Although the illustrated embodiment employs an electric motor (e.g., a fixed or variable speed DC or AC motor), it should be appreciated that motor 150 can alternatively be implemented with a gasoline or diesel-powered engine.

Portable concrete mixer 100 additionally includes a water supply system 160 best seen in FIG. 5. Water supply system 160 includes a connector 162, such as a standard ¾ inch female hose connector or "quick connect" connector, which supports attachment of a standard garden hose or water tank to provide a continuous supply of water. The input water flows through an input tube 164 to a metering device 166, such as a solenoid and/or manually actuated valve. Metering device 166 allows a user to increase or decrease the flow rate of water into hopper 120 and/or chute 130 via an output tube 168, for example, by rotating a control knob or lever. Thus, for example, in humid, damp, or wet conditions or in applications in which a drier mix is desired, the user can decrease the rate at which water is introduced into hopper 120 and/or chute 130, and in dry conditions or in applications in which a wetter mix is desired, the user can increase the rate at which water introduced into chute 130 in order to achieve a desired slurry consistency. The quantity of water supplied by water supply system 160 is preferably operator controlled and is non-volumetric with respect to the quantity of concrete mix loaded into hopper 120.

In some embodiments, output tube 168 introduces water into the dry concrete mix inside chute 130, for example, close to aperture 128. In other embodiments, which are presently preferred, output tube 168 introduces water into the dry concrete mix approximately in the center of base 126 of hopper 120 at a point very close to auger 170. This configuration provides more time for capillary action to begin, permits use of a shorter chute 130, and improves the homogeneity of the final slurry at the end of chute 130.

Figure 8:
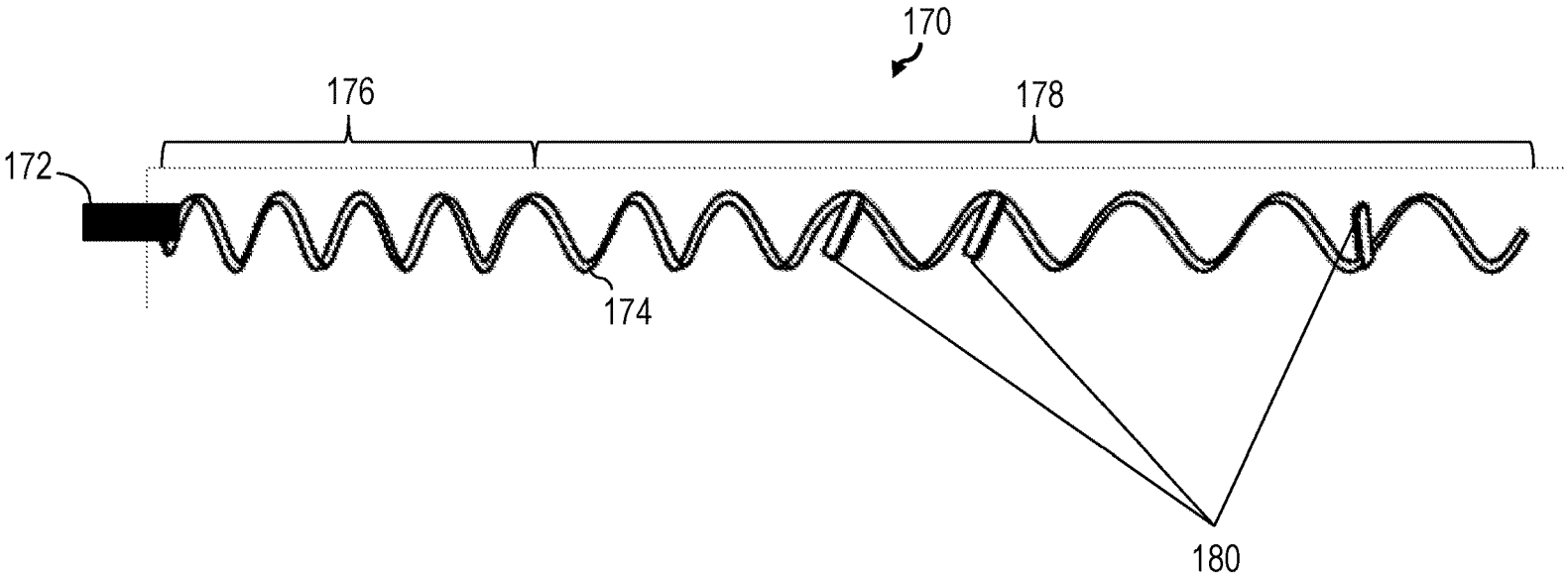
FIG. 8 is a more detailed view of an auger in accordance with one embodiment.

Referring now to FIG. 8, there is depicted a more detailed view of an auger 170 in accordance with one embodiment. As noted above, auger 170 is rotated by electric motor 150 to transport the dry concrete mix from hopper 120 through aperture 128 into chute 130, to mix the concrete mix with water in chute 130, and to transport the resulting ready-to-pour concrete slurry to open end 136 of chute 130.

In depicted embodiment, auger 170 includes a lug 172 by which auger 170 is coupled to electric motor 150 and an auger body 174, which are all preferably formed of steel. The design of auger body 174 promotes efficient and thorough mixing of the concrete mix and the water provided by water supply system. For example, in a preferred embodiment, auger body 174 takes the form of a shaftless helix (in the illustrated embodiment, a right handed helix) and, as such, importantly lacks a central shaft. The absence of a central shaft in auger body 174 promotes more thorough mixing of the water with the concrete mix and eliminates the numerous joints and crevices where slurry can more easily escape the cleaning process and thus build up and eventually reduce the advancement of the slurry down the chute and the ultimate mixing effectiveness of auger 170. The absence of a central shaft in auger body 174 also allows the portable concrete mixer 100 to accommodate the use of prepackaged concrete mixes with large gravel aggregates having grain sizes as large as 0.75 to 1.0 inch for an auger 170 having a substantially uniform exterior diameter of 2.5 inches measured orthogonally to the long axis of auger body 174.

Auger body 174 also preferably has an uneven pitch. In particular, first portion 176 of auger body 174 disposed within hopper 120 has a first lesser pitch, while second portion 178 of auger body 174 disposed in chute 130 (and possibly extending into hopper 120) preferably has a greater second pitch. In various implementations, the greater pitch of second portion 178 can either be fixed or can increase uniformly or step-wise over some or all of the length of second portion 178 as it extends from the first portion 176 toward open end outlet 136. As one example, the first portion 176 of auger body 174 disposed within hopper 120 may have a pitch-to-diameter ratio of between about 0.2 and 0.9, and more particularly, between about 0.4 and 0.6, and more particularly, of about 0.5 (e.g., a pitch of 1.25 inches for an auger diameter of 2.5 inches). In this example, the second portion 178 of auger body 174 disposed in chute 130 (and possibly extending into hopper 120) can have a pitch-to-diameter ratio at open end 136 of chute 130 in the range of about 0.3 to 1.8, and more particularly, of about 0.6 to 1.5 (e.g., a pitch of 1.5 to 3.75 inches for an auger diameter is 2.5 inches). In some embodiments, the first portion 176 may extend approximately 25% to 35% of the overall length of auger body 174, and second portion 178 may extend the remaining length of auger body 174. The relative lengths of first portion 176 and second portion 178 and their respective pitch-to-diameter ratios are preferably selected in combination with the slope of chute 130 to ensure sufficient mixing of the concrete slurry by the time it exits open end 136 of chute 130.

As further illustrated in FIG. 8, second portion 178 of auger body 174 has at least one, and preferably a plurality of fingers 180 extending into an interior volume of the helix. Fingers 180 function to interrupt and retard the flow of the wetted concrete mixture and to increase internal shear, thus improving the uniformity of mixing and ensuring a more homogeneous final mixture. Although the depicted embodiment employs fingers 180 that are formed of flat metal bar of rectangular cross-section, it should be appreciated that fingers 180 can alternatively take other cross-sectional shapes or combination of shapes such as a cylindrical or other cross-sectionally shaped rods in combination with a flat metal bar. It should be appreciated that there must be a minimum of one finger 180, with the best performance resulting from utilizing multiple fingers 180. In one preferred embodiment in which auger 170 is about 19 inches long and has an outer diameter of about 2.5 inches, auger body 174 includes four fingers 180, with the first positioned at aperture 128 in forward sidewall 124 of hopper 124, the second positioned about four inches down chute 130, the third positioned about eight inches from aperture 128, and the fourth about sixteen inches from aperture 128. The increased pitch of second portion 178 of auger body 174 is preferably selected to counter the resistance in flow (and subsequent velocity) offered by fingers 180. The increase in pitch along the length of auger body 174 moves the concrete mix along chute 130 with enough relative velocity to reduce or eliminate unwanted material build-up in chute 130.

Although the portable concrete mixer 100 described herein is capable of continuous operation, it should be appreciated that the flow of concrete slurry from chute 130 is continuous for only as long as the operator desires. If desired, the operator can stop the rotation of auger 170 for perhaps 15 or 20 minutes with partially mixed concrete mix in chute 130 and then resume operation without any problem in the working properties of the resulting concrete slurry.

As has been described, in at least some embodiments, a portable concrete mixer includes a frame and a hopper, coupled to the frame, for receiving therein dry concrete mix containing gravel aggregate, a chute coupled to the hopper, a water supply system that supplies water to the portable concrete mixer, a motor, and an auger coupled to and rotated by the motor. The auger includes a shaftless helical auger body extending from the hopper into the chute via an aperture in the hopper. The shaftless helical auger body has an interior volume and a plurality of fingers extending from the shaftless auger body into the interior volume. The shaftless helical auger body has an uneven pitch such that a second portion of the helical auger body in the chute has a greater pitch than a first portion of the shaftless helical auger body in the hopper.

While various embodiments have been particularly shown and described, it will be understood by those skilled in the art that various changes in form and detail may be made therein without departing from the spirit and scope of the appended claims and these alternate implementations all fall within the scope of the appended claims. References herein to an embodiment or embodiments do not necessarily refer to the same embodiment or embodiments. The terms "about" or "approximately," when used to modify quantities or ranges, are defined to mean the stated value(s) plus or minus 10%. The term "coupled" is defined to mean attachment of members possibly through one or more intermediate members.

What is claimed is:

1. A portable concrete mixer, comprising:

a frame;

a hopper, coupled to the frame, for receiving therein dry concrete mix containing gravel aggregate, the hopper having an aperture therein;

a chute coupled to the hopper;

a water supply system that supplies water to the portable concrete mixer;

a motor; and an auger coupled to and rotated by the motor, wherein the auger includes a shaftless helical auger body extending from the hopper into the chute via the aperture, wherein the shaftless helical auger body has an interior volume and a plurality of fingers extending from the auger body into the interior volume, and wherein the shaftless helical auger body has an uneven pitch such that a second portion of the helical auger body in the chute has a greater pitch than a first portion of the helical auger body in the hopper.

2. The portable concrete mixer of claim 1, wherein the motor is a DC motor.

3. The portable concrete mixer of claim 2, wherein the portable concrete mixer further comprises an AC to DC transformer.

4. The portable concrete mixer of claim 1, wherein the motor is coupled to the hopper.

5. The portable concrete mixer of claim 1, and further comprising at least one wheel coupled to the frame.

6. The portable concrete mixer of claim 5, wherein the frame further includes a plurality of rests for supporting the portable concrete mixer on a substrate.

7. The portable concrete mixer of claim 1, wherein:

the portable concrete mixer has a first side and an opposing second side; and the frame includes a handle extending from the first side to the second side.

8. The portable concrete mixer of claim 1, wherein at least a portion of the auger is covered by a guard.

9. The portable concrete mixer of claim 8, wherein the guard is pivotally coupled to the hopper.

10. The portable concrete mixer of claim 1, and further comprising a bag opening blade disposed within the hopper.

11. The portable concrete mixer of claim 1, wherein the portable concrete mixer has a weight of approximately 50 pounds.

12. The portable concrete mixer of claim 1, wherein the hopper has a rim having a maximum lift height of less than about three feet.

13. The portable concrete mixer of claim 1, wherein the second portion of the auger body has a pitch-to-diameter ratio of between about 0.3 and 1.8.

14. The portable concrete mixer of claim 13, wherein the first portion of the auger body has a pitch-to-diameter ratio of between about 0.2 and 0.9.

15. The portable concrete mixer of claim 1, wherein the water supply system includes a water outlet that provides water into the chute.

16. The portable concrete mixer of claim 1, wherein:

the hopper has a base; and the water supply system includes a water outlet that provides water into the hopper at the base.

17. The portable concrete mixer of claim 1, wherein one of the plurality of fingers is disposed approximately at the aperture.

18. The portable concrete mixer of claim 1, wherein the chute has a length of approximately 16 to 30 inches.

19. The portable concrete mixer of claim 1, wherein the chute has an angle relative to a level plane of approximately between −5 and 30 degrees of declination.

* * * * *